US012416480B2

(12) United States Patent
Petropoulos

(10) Patent No.: US 12,416,480 B2
(45) Date of Patent: Sep. 16, 2025

(54) DETONATOR SUPPORT DEVICE FOR CHARGING A BLASTHOLE, BLASTING SYSTEM, METHOD OF PREPARING A DETONATOR SUPPORT DEVICE, EXPLOSIVE MATERIAL CHARGING VEHICLE AND DATA MEDIUM

(71) Applicant: LUOSSAVAARA-KIIRUNAVAARA AB, Luleå (SE)

(72) Inventor: Nikolaos Petropoulos, Lulea (SE)

(73) Assignee: LUOSSAVAARA-KIIRUNAVAARA AB, Luleå (SE)

( * ) Notice: Subject to any disclaimer, the term of this patent is extended or adjusted under 35 U.S.C. 154(b) by 73 days.

(21) Appl. No.: 18/250,111

(22) PCT Filed: Oct. 20, 2021

(86) PCT No.: PCT/SE2021/051036
§ 371 (c)(1),
(2) Date: Apr. 21, 2023

(87) PCT Pub. No.: WO2022/086407
PCT Pub. Date: Apr. 28, 2022

(65) Prior Publication Data

US 2023/0400288 A1 Dec. 14, 2023

(30) Foreign Application Priority Data

Oct. 22, 2020 (SE) ..... 2051232-3

(51) Int. Cl.
*F42D 1/22* (2006.01)
*E21C 37/00* (2006.01)
(Continued)

(52) U.S. Cl.
CPC ..... *F42D 1/22* (2013.01); *E21C 37/00* (2013.01); *F42B 3/26* (2013.01); *F42D 3/04* (2013.01)

(58) Field of Classification Search
CPC . F42B 3/26; F42D 1/041; F42D 1/043; F42D 223/04; E21C 37/00; E21C 37/12
(Continued)

(56) References Cited

U.S. PATENT DOCUMENTS 473,734 A 4/1892 Forrester
2,536,869 A 1/1951 Bucky
(Continued)

FOREIGN PATENT DOCUMENTS

AU 2036999 A 9/1999
AU 2029402 A 9/2002
(Continued)

OTHER PUBLICATIONS

Atlas Copco: "Mining methods in underground mining", Second Edition, Dec. 31, 2007, Retrieved from the Internet: URL:https://batavia.internal.epo.org/citenpl/prod/web/citenpl/citenpl.html [Uploaded in 2 parts].
(Continued)

*Primary Examiner* — Troy Chambers
*Assistant Examiner* — Benjamin S Gomberg
(74) *Attorney, Agent, or Firm* — Knobbe, Martens, Olson & Bear, LLP

(57) ABSTRACT

The present invention regards a detonator support device (1) configured for internally supporting an elongated detonator unit (3), the detonator support device (1) exhibits an upper end (5) and a lower end (7) and comprises a first elongated sidewall (9) hingedly coupled to a second elongated sidewall (11) via a hinge member (13), a latching member (15) of the detonator support device (1) is wall (11) in a closed state. A
(Continued)

first cord clamping surface (17) of the first elongated sidewall (9) is configured to come in position opposite a second cord clamping surface (19) of the second elongated sidewall (11) in said closed state for engagement with at least one cord member (21). The present invention further regards a method of preparing a detonator support device and a blasting system (100).

18 Claims, 5 Drawing Sheets

(51) Int. Cl.
*F42B 3/26* (2006.01)
*F42D 3/04* (2006.01)

(58) Field of Classification Search
USPC ..... 102/313
See application file for complete search history.

(56) References Cited

U.S. PATENT DOCUMENTS

| | | | | |
|---|---|---|---|---|
| 3,438,325 | A | 4/1969 | Martin | |
| 3,615,351 | A | 10/1971 | Happel et al. | |
| 3,635,456 | A | 1/1972 | Anthes et al. | |
| 3,645,717 | A | 2/1972 | Meyer et al. | |
| 3,696,703 | A | 10/1972 | Fox | |
| 3,707,307 | A | 12/1972 | Kristoffersson et al. | |
| 3,748,120 | A | 7/1973 | Beggs et al. | |
| 3,779,741 | A | 12/1973 | Celada et al. | |
| 3,897,107 | A | 7/1975 | Haglund | |
| 3,939,771 | A | 2/1976 | McReynolds | |
| 4,036,100 | A | 7/1977 | Hurley | |
| 4,040,329 | A | 8/1977 | Ljungberg | |
| 4,040,330 | A | 8/1977 | Matzén | |
| 4,060,034 | A | 11/1977 | Bowman et al. | |
| 4,072,352 | A | 2/1978 | Janelid | |
| 4,324,390 | A | 4/1982 | Driemeyer | |
| 4,377,310 | A | 3/1983 | Gubin et al. | |
| 4,501,199 | A | 2/1985 | Mashimo et al. | |
| 4,522,125 | A | 6/1985 | Marz | |
| 4,581,712 | A | 4/1986 | Perry et al. | |
| 4,592,282 | A | 6/1986 | Niemi et al. | |
| 4,771,694 | A * | 9/1988 | Bartholomew | F42D 1/043 102/275.12 |
| 4,813,358 | A | 3/1989 | Roberts | |
| 4,829,902 | A | 5/1989 | Sharpe | |
| 4,938,536 | A | 7/1990 | Lee | |
| 5,007,683 | A | 4/1991 | Granskog | |
| 5,192,819 | A | 3/1993 | Baumgartner | |
| 5,198,613 | A | 3/1993 | Jenkins, Jr. | |
| 5,204,492 | A * | 4/1993 | Jacob | C06C 5/06 102/275.12 |
| 5,299,500 | A * | 4/1994 | Lindquist | F42D 1/043 102/275.12 |
| 6,070,511 | A | 6/2000 | Palmer | |
| 6,132,489 | A | 10/2000 | Villarreal-Trevino | |
| 6,395,056 | B1 | 5/2002 | Villarreal-Trevino et al. | |
| 6,397,754 | B1 | 6/2002 | Perlid | |
| 6,681,701 | B2 * | 1/2004 | Perry | F42D 1/043 102/275.7 |
| 7,175,690 | B2 | 2/2007 | Potter et al. | |
| 8,381,653 | B2 | 2/2013 | Zimmermann | |
| 8,943,944 | B2 * | 2/2015 | Zhang | E21B 43/116 175/4.58 |
| 9,062,953 | B2 | 6/2015 | Leppanen | |
| 9,273,368 | B2 | 3/2016 | Gordon | |
| 10,570,736 | B2 | 2/2020 | Wang | |
| 2005/0161257 | A1 | 7/2005 | Finden et al. | |
| 2007/0249204 | A1 * | 10/2007 | Petersen | F42D 1/055 439/208 |
| 2014/0150607 | A1 | 6/2014 | Gordon | |
| 2015/0259760 | A1 | 9/2015 | Eder et al. | |
| 2015/0275323 | A1 | 10/2015 | Hoffman | |
| 2016/0061572 | A1 * | 3/2016 | Eitschberger | F42C 19/12 29/592.1 |
| 2018/0106584 | A1 | 4/2018 | Santos et al. | |
| 2019/0292887 | A1 * | 9/2019 | Austin | F42D 1/05 |
| 2023/0203946 | A1 | 6/2023 | Wagner et al. | |
| 2023/0228193 | A1 | 7/2023 | Wagner et al. | |
| 2023/0384074 | A1 | 11/2023 | Petropoulos | |
| 2023/0392913 | A1 | 12/2023 | Petropoulos | |
| 2024/0124948 | A1 | 4/2024 | Eriksson et al. | |
| 2024/0279766 | A1 | 8/2024 | Sandberg et al. | |

FOREIGN PATENT DOCUMENTS

| | | | |
|---|---|---|---|
| AU | 766127 | B2 | 10/2003 |
| AU | 785047 | B2 | 9/2006 |
| CA | 703542 | A | 2/1965 |
| CA | 3176355 | A1 | 11/2021 |
| CN | 1029333 | C | 7/1995 |
| CN | 203837589 | U | 9/2014 |
| CN | 108253850 | A | 7/2018 |
| CN | 108374067 | A | 8/2018 |
| CN | 106894817 | | 11/2018 |
| CN | 110644997 | | 1/2020 |
| CN | 210293005 | U | 4/2020 |
| DE | 2106062 | A1 | 8/1971 |
| EP | 0018235 | A1 | 10/1980 |
| EP | 3222953 | A1 | 9/2017 |
| GB | 2532689 | A | 5/2016 |
| GB | 2577798 | A | 4/2020 |
| JP | S53-107683 | U | 8/1978 |
| JP | 2006/002193 | A | 1/2006 |
| JP | 2012102371 | A | 5/2012 |
| KR | 20100039491 | A | 4/2010 |
| RU | 2706994 | C1 | 11/2019 |
| SE | 465566 | B | 9/1991 |
| SE | 2150180 | A1 | 8/2022 |
| SU | 262127 | A1 | 12/1977 |
| WO | WO 1995/030068 | A1 | 11/1995 |
| WO | WO 1998/41811 | A1 | 9/1998 |
| WO | WO 2001/004563 | A1 | 1/2001 |
| WO | WO 2008/148544 | A1 | 12/2008 |
| WO | WO 2011/038449 | A1 | 4/2011 |
| WO | WO 2011/100808 | A1 | 8/2011 |
| WO | WO 2011/117394 | A1 | 9/2011 |
| WO | WO 2014/109755 | A1 | 7/2014 |
| WO | WO 2017/214422 | A1 | 12/2017 |
| WO | WO 2020/039332 | A1 | 2/2020 |
| WO | WO 2021/183022 | A1 | 9/2021 |
| WO | WO 2021/241272 | A1 | 12/2021 |

OTHER PUBLICATIONS

Bhaskar et al., "Decarbonization of the Iron and Steel Industry with Direct Reduction of Iron Ore with Green Hydrogen", Energies, 2020, 13, 758, in 23 pages.

Hudyma et al., "Monitoring open stope caving at Goldex Mine", Proceedings of the Second International Symposium on Block and Sublevel Caving, Dec. 31, 2010, pp. 133-144.

Mining Exploitation, https://www.ucursos.cl/ingenieria/2008/1/MI57E/1/material_docente/bajar?bajar=1&id=166065.

Manuel Enrique Aros Ulloa, "Stability of the production level in continuous mining", Thesis to Opt for the Title of Mining Civil Engineer, https://repositorio.uchile.cl/handle/2250/104852, University of Chile; Santiago de Chile, Oct. 2008.

"Room and Pillar", 2016, https://es.slideshare.net/LuisnArmandoLenCndor1/mtodo-de-room-and-pilar-59787116.

Aquise Cornejo Rutber, "Cut and fill, chambers and pillars: underground mining methods", https://www.gestiopolis.com/corte-y-relleno-camaras-y-pilares-metodos-demineriasubterranea/, Sep. 10, 2015.

Analysis of Induced Seismicity in the Rio Blanco Underground Mine, North Sector III Panel Areas 15, 16 and 17 Level 16 Collapsed Codelco Andina Division; Diego Romero Castro; Undergraduate thesis for the professional title of Geophysicist Concepción, Chile. Apr. 13, 2012: https://www.dgeo.udec.cl/wpcontent/uploads/2013/07/romero_diego_tesis.pdf.

(56) References Cited

OTHER PUBLICATIONS

International Search Report / Written Opinion of International Searching Authority for PCT/SE2021/051036 dated Nov. 1, 2021 in 14 pages.
International Preliminary Report on Patentability for PCT/SE2021/051036 dated Nov. 17, 2022 in 30 pages.
Written Opinion of the International Preliminary Examining Authority dated Jul. 15, 2022 in 8 pages.
First Notice and Search Report for SE2051232-3 dated May 5, 2021 in 12 pages.
Second Notice for SE2051232-3 dated Oct. 29, 2021 in 4 pages.
Third Notice for SE2051232-3 dated Jul. 15, 2022 in 6 pages.
International Search Report and Written Opinion in International Application No. PCT/SE2021/050475 dated Jun. 23, 2021 in 13 pages.
International Preliminary Report on Patentability in International Application No. PCT/SE2021/050475 dated Apr. 22, 2022 in 6 pages.
Notice (4 months) in Swedish Patent Application No. 2130072-8 dated Jun. 22, 2021 in 4 pages.
Final Notice (2 months) in Swedish Patent Application No. 2130072-8 dated Feb. 22, 2022 in 4 pages.
Swedish Search Report in Swedish Patent Application No. 2130072-8 dated Jun. 22, 2021 in 2 pages.
Notification of Transmittal of International Preliminary Report on Patentability for PCT/SE2021/051042 dated Nov. 17, 2022 in 19 pages.
International Search Report and Written Opinion of the International Searching Authority for PCT/SE2021/051042 dated Nov. 1, 2021 in 14 pages.
Written Opinion of the International Preliminary Examining Authority for PCT/SE2021/051042 dated Jul. 7, 2022 in 6 pages.
First Notice in Swedish Patent Application No. 2051234-9 dated May 5, 2021 in 9 pages.
Second Notice in Swedish Patent Application No. 2051234-9 dated Oct. 29, 2021 in 4 pages.
Third Notice in Swedish Patent Application No. 2051234-9 dated Jul. 7, 2022 in 4 pages.
Final Notice in Swedish Patent Application No. 2051234-9 dated Dec. 14, 2022 in 34 pages.
International Search Report and Written Opinion issued in International PCT Application No. PCT/SE2021/051040 dated Nov. 10, 2021 in 15 pages.
International Preliminary Report on Patentability for PCT/SE2021/051040 dated Nov. 24, 2022 in 16 pages.
First Notice and Search Report in Swedish Patent Application No. SE2051233-1 dated May 11, 2021 in 8 pages.
Second Notice for in Swedish Patent Application No. SE2051233-1 dated Nov. 8, 2021 in 4 pages.
Written Opinion of the International Preliminary Examining Authority issued in International Application No. PCT/SE2021/051040 dated Jul. 8, 2022 in 4 pages.
International Preliminary Report on Patentability in International Application No. PCT/SE2021/050477 dated Apr. 22, 2022 in 6 pages.
International Search Report in International Application No. PCT/SE2021/050477 dated Jun. 23, 2022 in 13 pages.
Notice (4 Months) in Swedish Patent Application No. 2150606-8 dated Jun. 22, 2021 in 5 pages.
Final Notice (2 Months) in Swedish Patent Application No. 2150606-8 dated Feb. 22, 2022 in 4 pages.
Swedish Search Report in Swedish Patent Application No. 2150606-8 dated Jun. 22, 2021 in 2 pages.
Eurasian Office Action in Eurasian application No. 202293280 dated Apr. 5, 2023 in 5 pages.
Eurasian Office Action in Eurasian application No. 202293281 dated Apr. 7, 2023 in 5 pages.
Notice and Search Report for SE 2150180-4 dated Oct. 14, 2021 in 11 pages.
Notice and Search Report for SE 2150180-4 dated May 31, 2023 in 5 pages.
International Preliminary Report on Patentability for PCT/SE2022/050182 dated Feb. 7, 2023 in 35 pages.
International Search Report and Written Opinion of the International Searching Authority for PCT/SE2022/050182 dated May 20, 2022 in 16 pages.
Office Action in EU Application No. 202391192 mailed on Sep. 12, 2023.
International Search Report and Written Opinion issued in International Application No. PCT/SE2022/050557 dated Jun. 16, 2022 in 14 pages.
Office Action issued in Swedish Application No. 2150736-3 dated Jul. 1, 2022 in 4 pages.
Office Action issued in Swedish Application No. 2150736-3 dated Mar. 1, 2022 in 8 pages.
International Preliminary Report on Patentability for PCT/SE2022/050557 dated Apr. 20, 2023 in 14 pages.

* cited by examiner

DETONATOR SUPPORT DEVICE FOR CHARGING A BLASTHOLE, BLASTING SYSTEM, METHOD OF PREPARING A DETONATOR SUPPORT DEVICE, EXPLOSIVE MATERIAL CHARGING VEHICLE AND DATA MEDIUM

TECHNICAL FIELD

The present invention relates to a detonator support device according to claim 1 and to a method of charging a blasthole according to claim 13.

The present invention primary concerns the mining industry making use of detonator support devices and applying charging methods.

The present invention also concerns the industry manufacturing detonator support devices configured to encompass a detonator unit.

BACKGROUND

In basting operations, at least one borehole being drilled in the rock and an explosive compound is positioned in the borehole. The explosive compound in the borehole is initiated by means of a detonator unit arranged in a detonator support device, causing fragmentation of the rock caused by the blast.

Current detonator supports used in the mining industry may slide along the detonation cord and fasten in the borehole or at the collar ring of the borehole due to transverse orientation in the borehole. Current detonator supports must be attached to the detonation cord before the detonation cord is inserted into the borehole. Current detonator supports can be complex to handle in mining and also often have superfluous components making the detonator support sensitive for malfunctions and being bulky.

One example of a detonator support is showed in WO2020039332A1 wherein the detonator unit is positioned in a housing having a first and second side wall that are hingedly connected along one longitudinal side and openable via a snap-fit coupling along the opposite longitudinal side.

The borehole generally has a vertical direction. However, the borehole may have different directions, such as generally horizontal or oblique directions.

SUMMARY OF THE INVENTION

There is an object to provide a detonator support that is easy and secure to handle and that at the same time provides secure attachment of the detonator support to the cord member (e.g. detonator cord).

There is an object to provide a detonator support that promotes time-saving operation and charging of a borehole.

There is an object that the operator always positions the detonator unit correctly in the detonator support device.

There is an object to provide a light-weight detonator support device.

There is an object to provide a compact detonator support device.

There is an object to provide a detonator support device that can be put into use in a flexible blasting system configured to be charged in a borehole of a mine.

There is an object to provide a detonator support device that can be used for different blasting charge applications and systems in a bore hole.

There is an object to provide a detonator support device that do not get stuck in the borehole or in the collar ring of the borehole during charging.

This or at least one of said objects has been achieved by a detonator support device configured for internally supporting an elongated detonator unit, the detonator support device exhibits an upper end and a lower end and comprises a first elongated sidewall hingedly coupled to a second elongated sidewall via a hinge member, a latching member of the detonator support device is configured to secure the first elongated sidewall to the second elongated sidewall in a closed state. A first cord clamping surface of the first elongated sidewall is configured to come in position opposite a second cord clamping surface of the second elongated sidewall in said closed state for engagement with at least one cord member.

Alternatively, the detonator support device interior is formed with an elongated detonator unit compartment corresponding with the dimensions of the detonator unit.

In such way the operator only can position the detonator unit in one possible way which increases security in a mine.

Alternatively, the interior of the detonator unit comprises a detonator and an explosive material, such as PETNs, configured to be coupled to the cord member.

Alternatively, the cord member comprises a shock tube or any type of flexible linear explosives or line having a core of explosive material encased in an outer jacket.

Alternatively, the operator mounts the detonator within the detonator unit, which is prefilled with explosive material, such as PETN.

In such way there is achieved a simple and secure handling of the detonator unit, as it is not allowed by regulation to have any pre-installed detonator in a detonator unit.

Alternatively, the elongated detonator unit is configured to be clipped into the detonator unit compartment of the detonator support device.

Alternatively, the step of preparing the elongated detonator unit comprises application of a second cord member to the elongated detonator unit.

Alternatively, the step of preparing the elongated detonator unit comprises application of a detonator coupled to the first or second cord member.

Alternatively, a hook element is arranged in the interior of the first and/or second elongated wall element at the upper and/or lower end of the detonator support device for holding the first and/or second cord member to the first and/or second elongated wall element.

Alternatively, the elongated detonator unit has a first end and a second end.

Alternatively, the first end is configured to receive the second cord member.

Alternatively, the cross-section of the elongated detonator unit taken perpendicular to the prolongation of the elongated detonator unit is asymmetrical.

Alternatively, the elongated detonator unit compartment is formed to receive the elongated detonator unit with a compartment space that exhibits mating asymmetrical cross-section.

Alternatively, the interior of the elongated detonator unit is filled with explosive, such as PETN based explosive.

Alternatively, the amount of PETN based explosive in the elongated detonator unit is 30-60 gram, preferably 40-50 gram of PETN.

In such way the time for preparation of the detonator support device can be very short. The assembly time for installation can be less than 10 seconds.

Alternatively, the first elongated sidewall comprises one opening for providing direct contact between the detonator unit and a blasting charge material to be filled in the blasthole (borehole into which the blasting charge material is inserted).

In such way the blasting charge material will fill up the detonator support device and coming into contact with the detonator unit.

In such way the operator does not have to add emulsion material or any additional emulsion cartridge in the detonator support device.

Alternatively, the detonator support device interior exhibits a conical element forming a focal charge, positioned co-linear with the elongated detonator unit at one end thereof and being configured to form a plasma jet for impacting the blasting charge material.

Alternatively, the coupling member is formed as a snap-fit having at least two snap members, one of which exhibits a different dimension than the other.

In such way is achieved that the coupling member, due to asymmetric forces holding the snap members securing the detonator support device, will be easy to open with one hand.

Alternatively, an outermost positioned snap member involves less snap-fit force than the other snap member or snap members.

In such way the operator can keep his gloves on. In such way, he must not expose his naked hands to the explosive material. Additionally, the explosive material contains oil and it may be hard to manage the operation of charging the borehole due to slippery tools etc.

Alternatively, the upper end comprises an upper through hole, through which the cord member is configured to pass and/or the lower end comprises a lower through hole, through which the cord member is configured to pass.

Alternatively, the detonator support device exhibits a prolongation extending along a centre line Alternatively, the upper and/or lower through hole exhibit/exhibits an extension oriented parallel with the centre line.

Alternatively, the hinge member exhibits an extension oriented parallel with the centre line.

Alternatively, the first cord clamping surface exhibits an extension oriented parallel with the centre line.

Alternatively, the second cord clamping surface exhibits an extension oriented parallel with the centre line.

Alternatively, the first cord clamping surface and second cord clamping surface form a first channel in said closed state.

Alternatively, the upper through hole and/or lower through hole are/is in open connection with the first channel and being co-linear with the first channel.

In such way is achieved that the detonator support device, by means of the provision that the cord member passes through the upper through hole and through the lower through hole (i.e. being in contact with the upper and lower end of the detonator support device), the risk of that the detonator support device orients perpendicular at the collaring of the borehole or in any cavity of the bore hole is eliminated.

Alternatively, the exterior of the first or second elongated sidewall is formed with a concave elongated recess extending along the prolongation of the first or second elongated sidewall.

In such way is also achieved that the required diameter of the borehole can be minimized as the charging hose can be encompassed in the concave elongated recess.

Alternatively, the elongated detonator unit compartment is formed inside the second elongated sidewall.

Alternatively, the interior of the second elongated sidewall is formed with a support member for supporting the detonator unit in said closed state.

Alternatively, the first and second cord clamping surfaces form a channel in said closed state, in which channel the cord member is held.

Alternatively, an outer wall surface of the elongated detonator unit, mounted in the elongated detonator unit compartment, acts as an engagement wall of said channel for engaging the cord member.

Alternatively, the detonator support, device comprises a holding device exhibiting a detonator support device receiving portion formed with a cavity configured to encompass the lower end of the detonator support device, an intermediate portion formed with a hollow space configured to encompass a charging hose nozzle, and a radially outward extending borehole plug portion configured to engage the borehole.

In such a way is provided a plug member designed to be anchored in the borehole in a safe way at the same time as the detonator support device supporting the detonator unit secure and efficiently can be positioned in the borehole.

Alternatively, the detonator support device is configured to be releasable coupled to the holding device.

Alternatively, the upper end of the detonator support device is conically shaped having an upper tip facing away from the detonator support device.

Alternatively, the lower end of the detonator support device is conically shaped having a lower tip facing away from the detonator support device.

Alternatively, the detonator support device receiving portion comprises a circular wall cut with an open slot configured to receive the cord member exiting from the detonator support device, when the detonator support device has been coupled to the detonator support device receiving portion of the holding device.

Alternatively, the detonator support device receiving portion is formed with an inwardly facing wall section having a bulge portion configured to mate the elongated recess of the first elongated sidewall.

Alternatively, the intermediate portion is formed of a circular wall having at least one aperture configured to permit blasting charge material to pass there through from the charging hose nozzle to the borehole.

Alternatively, the radially outward extending borehole plug portion comprises flexible outward projecting tabs, each of which having an outermost cut end configured to engage the wall of the borehole.

Alternatively, at least one of the flexible outward projecting tabs comprises a cord member engagement recess into which the cord member is introduced, when the detonator support device has been coupled to the detonator support device receiving portion of the holding device.

Alternatively, the cord member engagement recess is formed in, a radially oriented side portion of the at least one flexible outward projecting tab.

In such way is achieved that the bulge portion of the an inwardly facing wall section of the detonator support device receiving portion of the holding device is configured to be encompassed in at least one portion of the elongated recess preventing undesired relative rotation between the detonator support device and the holding device.

In such way the cord member coming from the detonator support device and running through the holding device would not be subjected to unwanted stretching or other impact.

At the same time, the concave elongated recess is configured to encompass a charging hose used for charging the borehole with the detonator support device, the cord member and the explosive compound, which charging hose runs between the borehole wall and the detonator support device.

This or at least one of said objects has been achieved by a blasting system configured to be charged in a borehole, the system comprises a first detonator support device configured for internally supporting a first elongated detonator unit, the first detonator support device exhibits an upper end and a lower end and comprises a first elongated sidewall hingedly coupled to a second elongated sidewall via a hinge member, a latching member of the first detonator support device is configured to secure the first elongated sidewall to the second elongated sidewall in a closed state, a first cord clamping surface of the first elongated sidewall is configured to come in position opposite a second cord clamping surface of the second elongated sidewall in said closed state for engagement with a first cord member, the blasting system further comprises; a first holding device configured to engage the borehole and carry the first detonator support device, a second detonator support device being engaged to the first cord member at a distance from the first detonator support device.

Alternatively, a second cord member is coupled to the first detonator unit of the first detonator support device and is configured to be clamped between a third cord clamping surface of the first elongated sidewall and a fourth cord clamping surface of the second elongated sidewall.

Alternatively, a third cord member is coupled to the second detonator unit of the second detonator support device and is configured to be clamped between a fifth cord clamping surface of the first elongated sidewall and a sixth cord clamping surface of the second elongated sidewall of the second detonator support device.

Alternatively, the first cord member comprises a detonation cord and/or a shock tube.

Alternatively, the second and/or third cord member comprise/comprises detonation cord and/or a shock tube.

Alternatively, the second detonator support device is configured for internally supporting a second elongated detonator unit, the second detonator support device exhibits an upper end and a lower end and comprises a first elongated sidewall hingedly coupled to a second elongated sidewall via a hinge member, a latching member of the second detonator support device is configured to secure the first elongated sidewall to the second elongated sidewall of the second detonator support device in a closed state, a first cord clamping surface of the first elongated sidewall of the second detonator support device is configured to come in position opposite a second cord clamping surface of the second elongated sidewall of the second detonator support device in said closed state for engagement with the first cord member.

Alternatively, the first holding device exhibits an upper portion comprising a detonator support device receiving portion formed with a cavity configured to encompass the lower end of the first detonator support device, an intermediate portion formed with an abutment surface configured to engage a charging hose nozzle, and a lower portion comprising a radially outward extending borehole plug portion configured to engage the borehole.

Alternatively, a second holding device exhibits an upper portion comprising a detonator support device receiving portion formed with a cavity configured to encompass the lower end of the second detonator support device, an intermediate portion formed with an abutment surface configured to engage the charging hose nozzle, and a lower portion comprising a radially outward extending borehole plug portion configured to engage the borehole.

Alternatively, the first holding device constitutes a support claw configured to engage the borehole and being fixed to an upper end of the first cord member.

Alternatively, the first holding device configured to engage the borehole and carry the first detonator support device by means of the first cord member.

Alternatively, the first detonator support device being in engagement with the first cord member is carried at a distance from the first holding device.

Alternatively, the second detonator support device being in engagement with the first cord member is carried at a distance from the first support device.

Alternatively, a third detonator support device being in engagement with the first cord member is carried at a distance from the second support device.

Alternatively, the second and/or third detonator support device feature/features the same technical attributes as the first detonator support device.

In such way is achieved a blasting system that is efficient to handle and promotes cost-efficient mining.

In such way each detonator support device successively and continuously can be clamped onto and along the first cord member and securely closed and well protected.

This or at least one of said objects has been achieved by a method of preparing a first detonator support device to be charged in a borehole, the first detonator support device is configured for internally supporting a first elongated detonator unit, the first detonator support device exhibits an upper end and a lower end and comprises a first elongated sidewall hingedly coupled to a second elongated sidewall via a hinge member, a latching member of the detonator support device is configured to secure the first elongated sidewall to the second elongated sidewall in a closed state, a first cord clamping surface of the first elongated sidewall is configured to come in position opposite a second cord clamping surface of the second elongated sidewall in said closed state for engagement with at least one cord member, the method comprises the steps of: providing the first detonator support device; preparing the first elongated detonator unit; mounting the first elongated detonator unit in the first detonator support device; positioning the cord member at the first or second cord clamping surface; closing and latching the first detonator support device in said closed state.

Alternatively, the method comprises the further steps of: providing a second detonator support device; preparing the second elongated detonator unit; mounting the second elongated detonator unit in the second detonator support device; positioning the cord member at a first or second cord clamping surface of the second detonator support device; closing and latching the detonator support device in said closed state.

Alternatively, the first detonator support device is configured to be coupled to a first holding device exhibiting an upper portion comprising a detonator support device receiving portion formed with a cavity configured to encompass the lower end of the first detonator support device, an intermediate portion formed with a abutment surface configured to engage a charging hose nozzle, and a lower portion comprising a radially outward extending borehole plug portion configured to engage the borehole, the method comprises the further step of: mounting the prepared first detonator support device to the detonator support device receiving portion of the first holding device; engaging the charging hose nozzle with the intermediate portion of the first holding device; propelling the charging hose nozzle into the borehole, charging the borehole with an explosive compound, and returning the charging hose nozzle.

Alternatively, the second detonator support device is configured to be coupled to a second holding device exhibiting an upper portion comprising a detonator support device receiving portion formed with a cavity configured to encompass the lower end of the second detonator support device, an intermediate portion of the second holding device formed with a abutment surface configured to engage the returned charging hose nozzle, and a lower portion of the second holding device comprising a radially outward extending borehole plug portion configured to engage the borehole, the method comprises the further step of: mounting the prepared second detonator support device to the detonator support device receiving portion of the second holding device; engaging the charging hose nozzle with the intermediate portion of the second holding device; propelling the charging hose nozzle into the borehole, charging the borehole with an explosive compound, and returning the charging hose nozzle.

This or at least one of said objects has been achieved by an autonomous or semi-automatic explosive material charging vehicle.

This or at least one of said objects has been achieved by a data medium and a data medium product.

The bore hole may be defined as a blast hole, i.e. a bore into which the blasting charge material is to be inserted.

BRIEF DESCRIPTION OF THE DRAWINGS

The present invention will now be described by way of examples with references to the accompanying schematic drawings, of which.

DETAILED DESCRIPTION

Hereinafter, exemplary embodiments of the present invention will be described with reference to the accompanying drawings, wherein for the sake of clarity and understanding of the invention some details of no importance may be deleted from the drawings.

Figure 1:
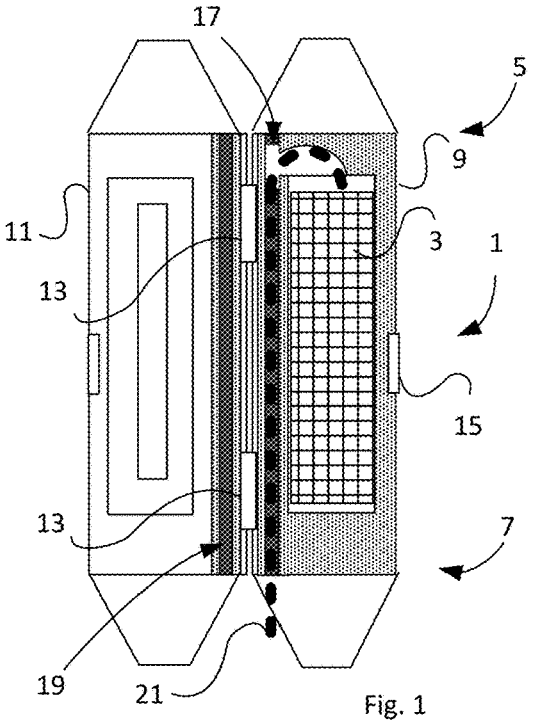
FIG. 1 illustrates a detonator support device according to a first example.

FIG. 1 illustrates a detonator support 1 according to a first example. The detonator support 1 is configured for internally supporting an elongated detonator unit 3. The detonator support 1 exhibits an upper end 5 and a lower end 7 and comprises a first elongated sidewall 9 hingedly coupled to a second elongated sidewall 11 via a hinge 13. A latch 15 of the detonator support 1 is configured to secure the first elongated sidewall 9 to the second elongated sidewall 11 in a closed state. A first cord clamping surface 17 of the first elongated sidewall 9 is configured to come in position opposite a second cord clamping surface 19 of the second elongated sidewall 11 in said closed state for engagement with at a primer cord 21, such as a detonation cord or a shock tube.

Figure 2:
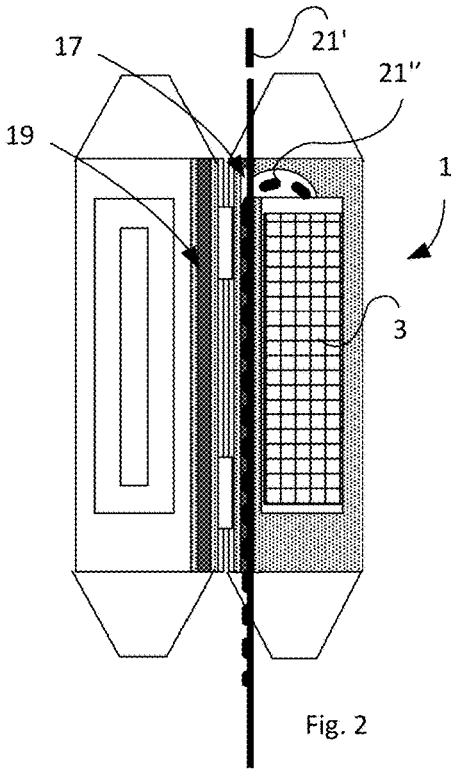
FIG. 2 illustrates a detonator support device according to a second example.

FIG. 2 illustrates a detonator support 1 according to a second example. The detonator support 1 is configured for internally supporting an elongated detonator unit 3. A first cord clamping surface 17 is configured to come in position opposite a second cord clamping surface 19 in a closed state of the detonator support 1 for engagement with two primer cords, such as a detonation cord 21' and a shock tube 21".

Figure 3:
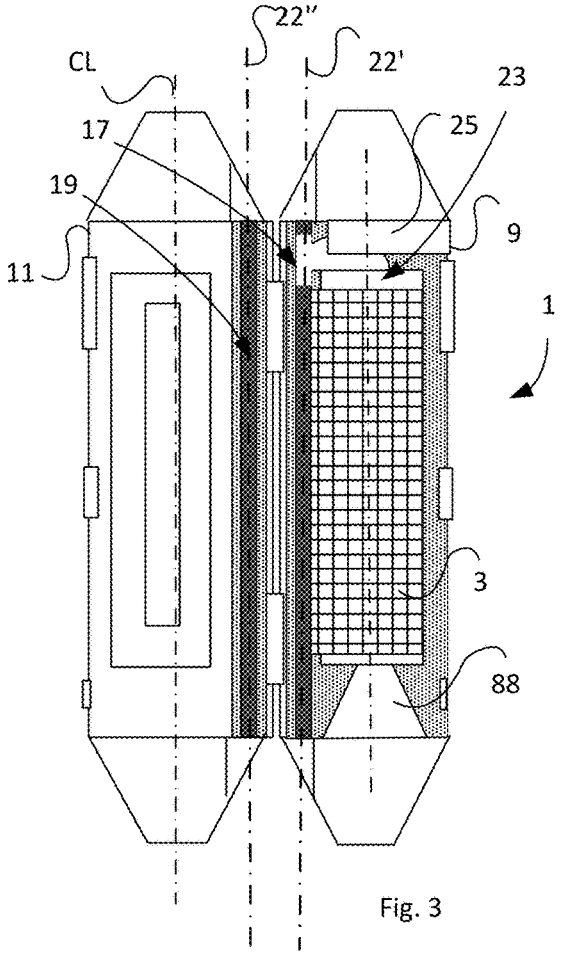
FIG. 3 illustrates a detonator support device according to a third example.

FIG. 3 illustrates a detonator support 1 according to a third example. The detonator support 1 is configured for internally supporting an elongated detonator unit 3. The elongated detonator unit 3 has a prolongation parallel with the centre line CL of the detonator support 1.

A first cord clamping surface 17 is configured to come in position opposite a second cord clamping surface 19 in a closed state of the detonator support 1 for engagement with a primer cord (not shown). The first cord clamping surface 17 having a first imaginary axis 22' and second cord clamping surface 19 having a second imaginary axis 22" form a cord channel in said closed state, wherein the first imaginary axis 22' coincides with the second imaginary axis 22". The orientation of the first and second imaginary axis 22', 22" is parallel with the centre line CL of the detonator support 1. The detonator support 1 comprises a first elongated sidewall 9 hingedly coupled to a second elongated sidewall 11.

The interior of the detonator support 1 is formed with a detonator unit compartment 23 corresponding with the dimensions of the detonator unit 3 configured to be mounted in the detonator support 1. The interior of the detonator unit 3 comprises a detonator (not shown) and an explosive material (not shown), such as PETNs, configured to be coupled to the primer cord.

The primer cord may comprise a shock tube or any type of flexible linear explosives or any line having a core of explosive material encased in an outer jacket.

In such way there is achieved a simple and secure handling of the detonator unit, as it is not allowed by regulation to have any pre-installed detonator in a detonator unit.

Alternatively, the detonator unit 3 is configured to be clipped into the detonator unit compartment 23.

Alternatively, a step of preparing the detonator unit 3 may comprise application of a second cord member to the detonator unit 3.

Alternatively, a hook element is arranged in the interior of the first and/or second elongated wall element at the upper and/or lower end of the detonator support 1 for holding the first and/or second cord member to the first and/or second elongated wall element.

Alternatively, the cross-section of the elongated detonator unit taken perpendicular to the prolongation of the elongated detonator unit is asymmetrical (see e.g. FIG. 4) and the detonator unit compartment 23 is formed to receive the detonator unit 3 with a compartment space that exhibits mating asymmetrical cross-section.

In such way the operator only can position the detonator unit in one possible way which increases safety and efficiency in a mine.

Alternatively, the interior of the detonator unit 3 prepared with explosive, such as PETN based explosive.

Alternatively, the amount of PETN based explosive in the elongated detonator unit is 30-60 gram, preferably 40-50 gram of PETN.

In such way the time for preparation of the detonator support device can be very short. The assembly time for installation can be less than 10 seconds.

In addition, the detonator support may comprise a conical element 88 at the lower end for increasing the probability of detonation the explosive around it.

Figure 4:
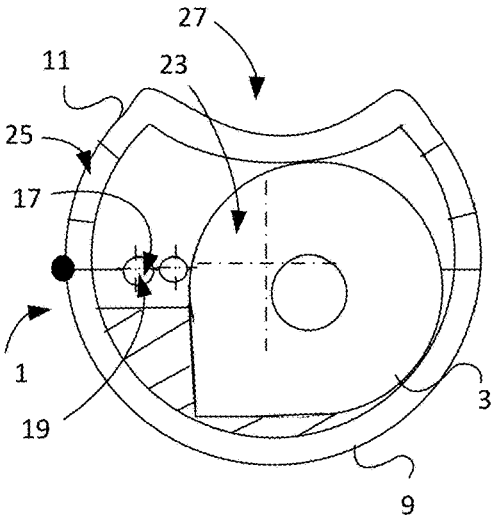
FIG. 4 illustrates in cross-section a detonator support device according to a fourth example.

FIG. 4 illustrates in cross-section a detonator support device according to a fourth example. The cross-section of a detonator unit 3 taken perpendicular to the prolongation of the detonator unit 3 is asymmetrical and the detonator unit compartment 23 is formed to receive the detonator unit 3 with a compartment space that exhibits mating asymmetrical cross-section. The detonator support 1 comprises a first elongated sidewall 9 hingedly coupled to a second elongated sidewall 11.

Alternatively, a first cord clamping surface 17 of the first elongated sidewall 9 is configured to come in position opposite a second cord clamping surface 19 of the second elongated sidewall 11 in a closed state of the detonator support 1. In said closed state, the second elongated sidewall 11 holds the detonator unit in fixed position in the detonator support 1.

Alternatively, the first and/or second elongated sidewall 9, 11 comprise/comprises at least one opening 25 for providing direct contact between the detonator unit 3 and a blasting charge material to be filled in a borehole to be charged.

The exterior of the second elongated sidewall 11 is formed with a concave elongated recess 27 extending along the prolongation of the second elongated sidewall 11.

In such way is achieved that the required diameter of the borehole can be minimized as a charging hose (not shown), configured to insert the detonator support 1 into the borehole, can be encompassed in the concave elongated recess 27.

Figure 5A:
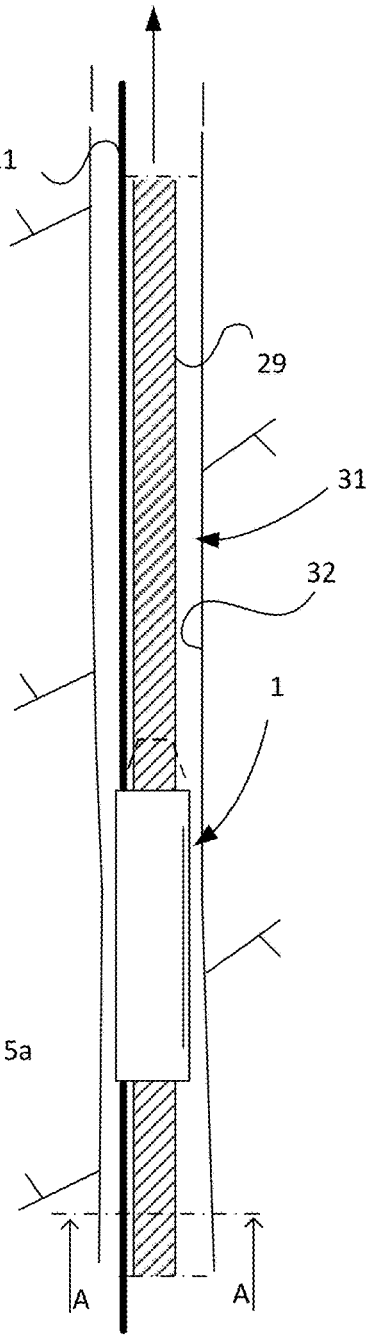
FIGS. 5*a*-5*c* illustrate a detonator support device in exemplary charging procedures.
Figure 5B:
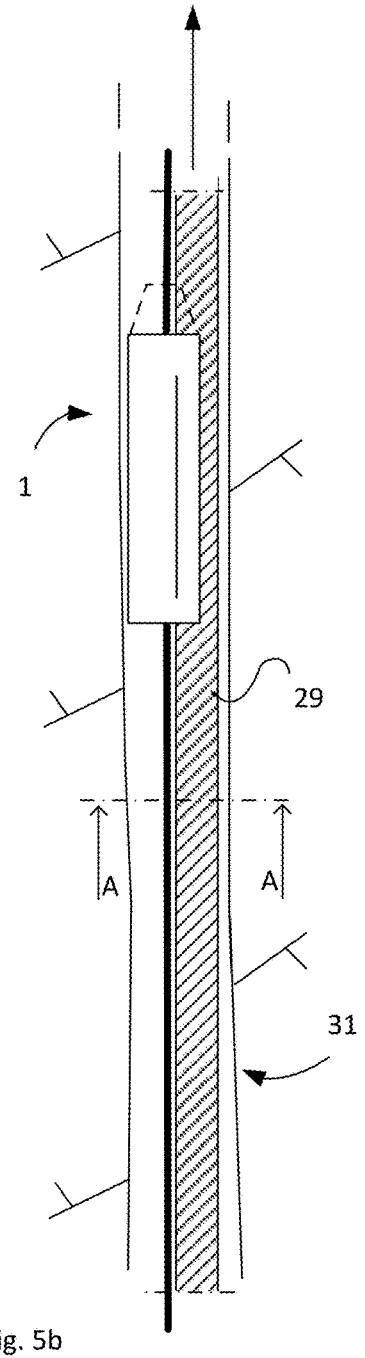
Figure 5C:
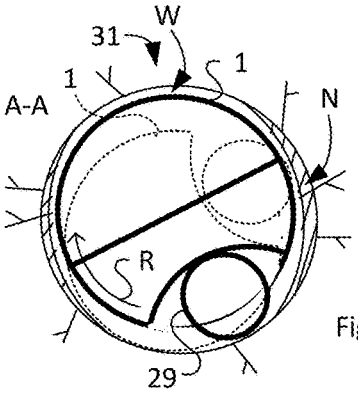

As shown in FIGS. 5*a*-5*c*, a detonator support 1 is positioned in and moved along a borehole 31. FIG. 5*a* shows that the detonator support 1 has been fixedly clipped to a detonation cord 21. A charging hose 29 is moved upward pushing a support claw (not shown) to an end position of the borehole, which support claw carries the detonation cord 21 and thus also carries the detonator support 1.

A concave elongated recess (see e.g. FIG. 4) is configured to encompass the charging hose 29 used for charging the borehole 31 with the detonator support 1, the detonation cord 21 and the explosive compound (not shown) used for blasting the borehole 31, which charging hose 29 runs between a wall 32 of the borehole 31 and the detonator support 1. FIG. 5*b* shows that the charging hose 29 has moved the detonator support 1 a further distance upward. At cross-section A-A, the borehole 31 narrows N in one direction normal to the extension of the borehole, but widen W in transverse direction and the charging hose 29 rotates R with the detonator support 1 at the geometry change of the borehole cross-section and adapts to the actual geometry as shown in FIG. 5*c*.

Figure 6:
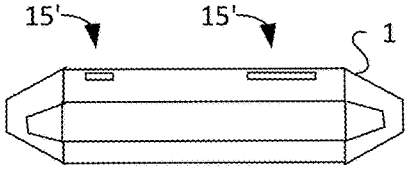
FIG. 6 illustrates a detonator support device according to a sixth example.

FIG. 6 illustrates a detonator support 1 according to a sixth example. A snap-fit coupling 15' is formed with at least two snap members, one of which exhibits a different dimension than the other. In such way is achieved that the snap-fit coupling 15', due to asymmetric forces securing the detonator support 1, will be easy to open with one hand. An operator (not shown) can keep his gloves on and must not expose his naked hands.

Figure 7:
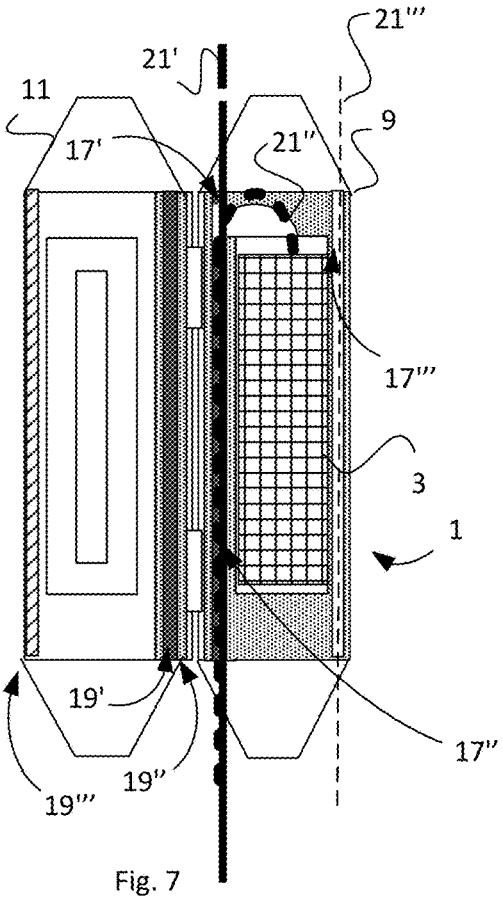
FIG. 7 illustrates a detonator support device according to a seventh example.

FIG. 7 illustrates a detonator support 1 according to a seventh example. A first cord clamping surface 17' of a first elongated sidewall 9 and second cord clamping surface 19' of a second elongated sidewall 11 form a first channel for holding a detonation cord 21' in a closed state of the detonator support 1. A shock tube 21" is coupled to a detonator unit 3 of the detonator support 1 and is configured to be clamped between a third cord clamping surface 17" of the first elongated sidewall 9 and a fourth cord clamping surface 19" of the second elongated sidewall 11.

A third cord 21'" is coupled to the detonator support 1 and is configured to be clamped between a fifth cord clamping surface 17'" of the first elongated sidewall 9 and a sixth cord clamping surface 19'" of the second elongated sidewall 11 of the detonator support 1.

Figure 8A:
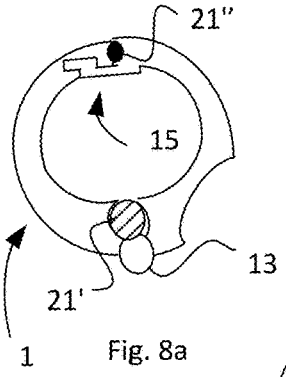
FIGS. 8*a*-8*b* illustrate in cross-section a detonator support device according to an eight example.
Figure 8B:
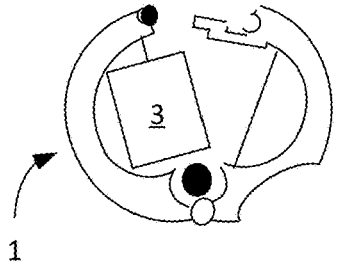

FIGS. 8*a*-8*b* illustrate in cross-section a detonator support 1 according to an eight example. A detonator unit 3 exhibits a rectangular cross-section. A first shock tube 21' is clamped between sidewalls of the detonator support 1 adjacent a hinge 13. A second shock tube 21" is clamped between the sidewalls of the detonator support 1 adjacent a latch 15 of the detonator support 1. FIG. 8*a* shows a closed state of the detonator support 1 and FIG. 8*b* shows the detonator support 1 being opened toward an open state.

Figure 9B:
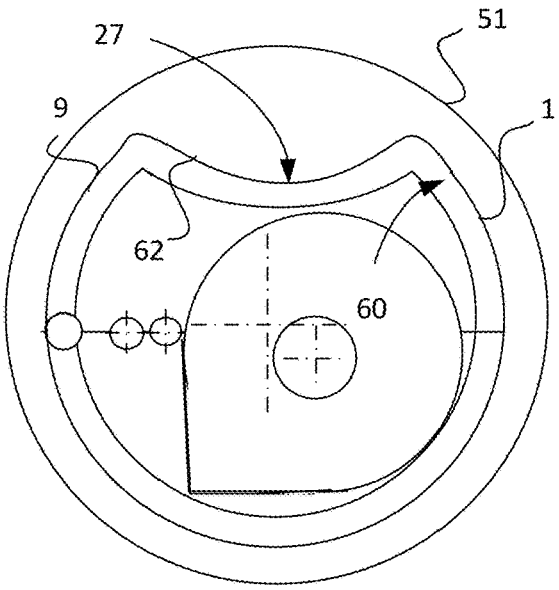
FIGS. 9*a*-9*b* illustrate a holding device configured to engage the borehole and carry a detonator support device according to a ninth example.
Figure 9A:
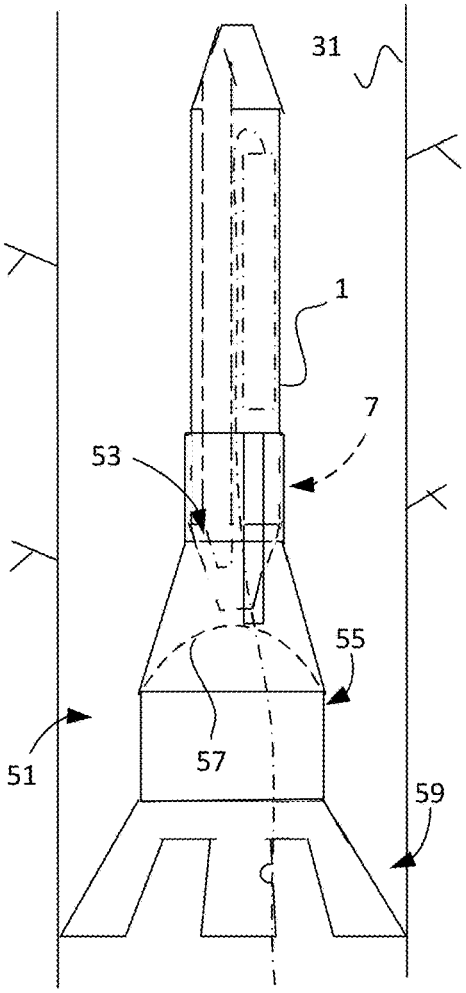

FIGS. 9*a*-9*b* illustrate a holding device 51 configured to engage a borehole 31 and carry a detonator support 1 according to a ninth example. As shown in FIG. 9*a*, the detonator support 1 comprises the holding device 51 exhibiting a detonator support device receiving portion 53 formed with a cavity configured to encompass the lower end 7 of the detonator support 1. An intermediate portion 55 is formed with an abutment surface 57 configured to engage a charging hose nozzle (not shown) configured to insert the holding device 51 into the borehole 31 and carrying the detonator support 1. A radially outward extending borehole plug portion 59 is configured to engage the borehole 31.

Alternatively, the radially outward extending borehole plug portion 59 preferably comprises a resilient material allowing resilient deformation of the oblique and outward extending wings or flaps allowing the radially outward extending borehole plug portion 59 to engage the wall of the borehole 31, FIG. 9*b* shows the detonator support 1 comprising the holding device 51 in cross-section. The detonator support device receiving portion 53 (see FIG. 9*a*) of the holding device 51 encompasses the lower end 7 of the detonator support 1. The detonator support device receiving portion 53 of the holding device 51 is formed with an inwardly facing wall section 60 having a bulge portion 62 configured to mate a concave elongated recess (also see e.g. ref. 27, FIG. 4) of the detonator support. The concave elongated recess 27 extends along the prolongation of an elongated sidewall 9 of the detonator support 1. The bulge portion 62 of the an inwardly facing wall section 60 of the detonator support of the holding device 51 is configured to be encompassed in the concave elongated recess 27 preventing undesired relative rotation between the detonator support 1 and the holding device 51.

Figure 10A:
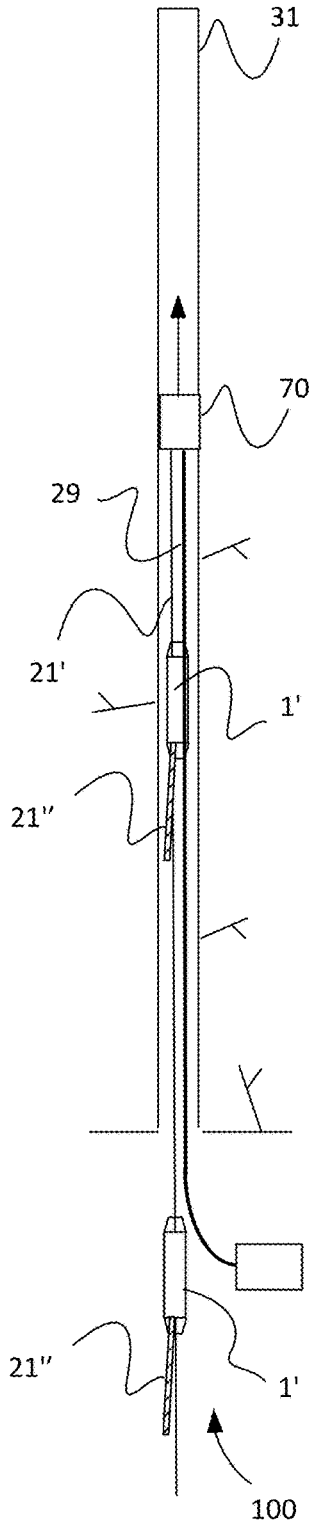
FIGS. 10*a*-10*c* illustrate different examples of a blasting system to be charged in a borehole.
Figure 10B:
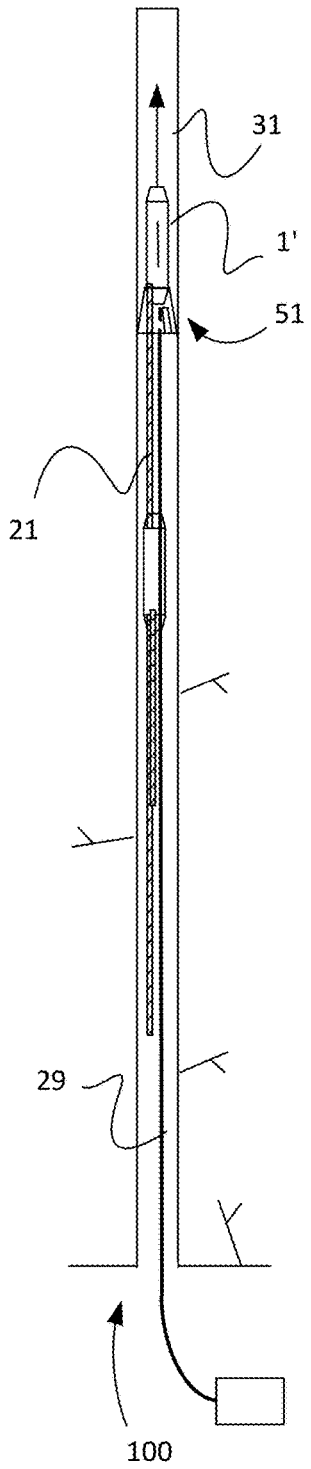
Figure 10C:
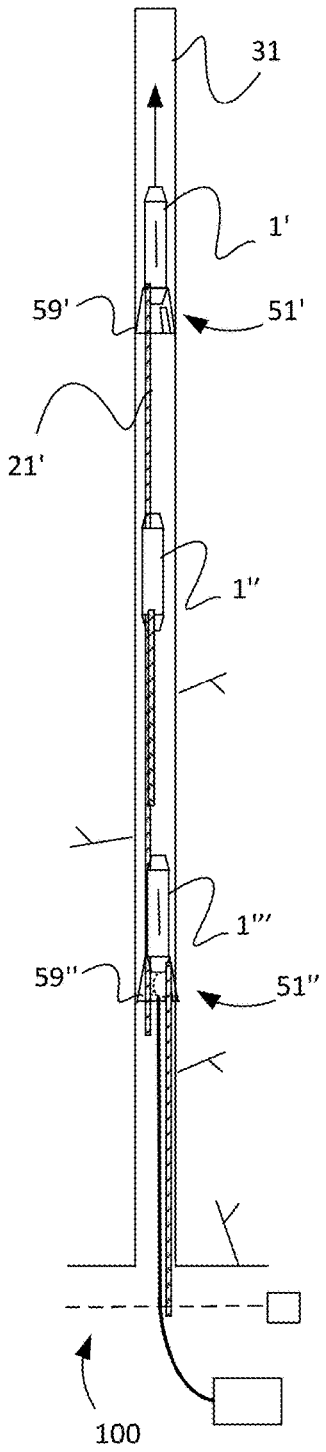

FIGS. 10*a*-10*b* show different examples of a blasting system 100 and illustrate exemplary methods of preparing detonator supports 1', 1" to be charged in a borehole 31. FIG. 10*c* illustrates an exemplary blasting system 100 and a method of charging a further third detonator support 1'". In FIG. 10*a* is shown a borehole plug or a support claw 70 being attached to a detonation cord 21'. The support claw 70 is driven toward the bottom of the borehole 31 by means of a charging hose 29. As the charging hose 29 is pushing the support claw 70 toward the bottom of the borehole 31. An operator (not shown) fixes the first detonator support 1' ("clip on") onto the detonation cord 21' when the support claw 70 has been pushed in the borehole 31 with the detonation cord 21' a certain distance.

The "clip on" functionality achieved by a first cord clamping surface of a first elongated sidewall configured to come in position opposite a second cord clamping surface of a second elongated sidewall in a closed state for engagement with the detonation cord 21'. A shock tube 21" has been coupled to a first detonator unit (not shown) of the first detonator support 1' (also "clipped on" by said functionality to the).

As shown in FIG. 10*a*, the support claw 70 thus carries the detonation cord 21' and the first detonator support 1'. The second detonator support 1", comprising a shock tube 21" coupled to a second detonator unit, is "clipped on" the detonation cord 21' at a position outside the borehole 31.

The present detonator support permits no misplacement of the detonator unit, since the detonator unit has its own predefined location. The detonator support does not need any emulsion cartridge. The assemble time for installation of the detonator support may be less than 10 seconds.

The detonator unit is placed in the detonator support. The detonator unit is prefilled with explosive material, such as PETN.

Successively, the detonator unit is clipped into the detonator support and the detonation cord 21' is placed and locked in a channel formed by a first cord clamping surface and second cord clamping surface in a closed state.

The detonator support may have an upper "fix to position element", which guides the shock tube 21" into the channel. In addition, the detonator support comprises a conical element at the lower end for increasing the probability of detonation the explosive around it. The conical element forms a so-called focal charge which forms a plasma jet impacting the explosive. The detonator support comprises several openings around it to increase the direct contact between the detonator unit and the explosive in the borehole.

The length of the detonator support is 150-200 mm, preferably 180-190 mm. The diameter of the detonator support is 25-40 mm, preferably 30-40 mm.

The interior of the detonator support may comprise various dimensions of snap members of a latching member for securing the first and second elongated side walls to each other. In such way the detonator support can be managed by an operator by using only one hand, for example by applying pressure at the middle of the detonator support to lock the detonator support.

In FIG. 10*b* is shown an exemplary method making use of a holding device 51 coupled to and carrying a detonator support 1. A charging hose 29 moves the holding device 51 upward in the borehole 31. The holding device 51 is configured to engage the borehole 31 and carry a first detonator support 1'. A second detonator support 1" is clamped onto a shock cord 21, which is coupled to the first detonator support 1'. After final positioning of the blasting system 100, the charging hose 29 is fed with explosive compound to fill the borehole 31.

In FIG. 10*c* is shown a blasting system 100 configured to be charged in a borehole 31. The system 100 comprises a first detonator support 1' configured for internally supporting a first elongated detonator unit (not shown).

The first detonator support 1' exhibits an upper end and a lower end and comprises a first elongated sidewall hingedly coupled to a second elongated sidewall via a hinge member (not shown). A latching member (not shown) of the first detonator support 1' is configured to secure the first elongated sidewall to the second elongated sidewall in a closed state. A first cord clamping surface (not shown) of the first elongated sidewall is configured to come in position opposite a second cord clamping surface (not shown) of the second elongated sidewall in said closed state for engagement with a first cord member 21'.

The blasting system 100 further comprises a first holding device 51' configured to engage the borehole 31 and to carry the first detonator support 1'. The first holding device 51' exhibits an upper portion comprising a detonator support device receiving portion (not shown) formed with a cavity configured to encompass the lower end of the first detonator support device, an intermediate portion formed with an abutment surface (not shown) configured to engage a charging hose nozzle of a charging hose (not shown), and a lower portion comprising a radially outward extending borehole plug portion 59' configured to engage the borehole. The charging hose is used to push the first detonator support 1' upward.

A second detonator support 1" is engaged to the first cord member 21' at a distance from the first detonator support 1'. The second detonator support 1" is configured for internally supporting a second elongated detonator unit (not shown). The second detonator support 1" exhibits an upper end and a lower end and comprises a first elongated sidewall hingedly coupled to a second elongated sidewall via a hinge member. A latching member of the second detonator support is configured to secure the first elongated sidewall to the second elongated sidewall of the second detonator support in a closed state, and a first cord clamping surface of the first elongated sidewall of the second detonator support is configured to come in position opposite a second cord clamping surface of the second elongated sidewall of the second detonator support in said closed state for engagement with the first cord member 21'.

A second holding device 51" coupled to a third detonator support 1'" exhibits an upper portion comprising a detonator support device receiving portion formed with a cavity configured to encompass the lower end of the second detonator support device, an intermediate portion formed with an abutment surface configured to engage the charging hose nozzle, and a lower portion comprising a radially outward extending borehole plug portion 59" configured to engage the borehole.

After each positioning of the respective first 1' and third detonator support 1''' by means of the charging hose, a section of the borehole 31, associated with the respective detonator support, is filled with explosive compound.

The intermediate portion of the first holding device 51' wall is formed with holes so that the pumped explosive compound is forced upward in the borehole for filling up the section of the borehole 31 associated with the first detonator support 1'.

Figure 11:
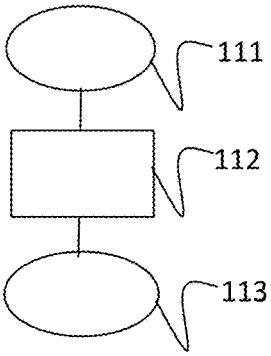
FIG. 11 illustrates a flowchart showing an exemplary method of preparing a first detonator support device to be charged in a borehole.

FIG. 11 illustrates a flowchart showing an exemplary method of preparing a detonator support device to be charged in a borehole. The detonator support device is configured for internally supporting an elongated detonator unit, the detonator support device exhibits an upper end and a lower end and comprises a first elongated sidewall hingedly coupled to a second elongated sidewall via a hinge member, a latching member of the detonator support device is configured to secure the first elongated sidewall to the second elongated sidewall in a closed state. A first cord clamping surface of the first elongated sidewall is configured to come in position opposite a second cord clamping surface of the second elongated sidewall in said closed state for engagement with at least one cord member.

The method comprises a first step 111 starting the method. A second step 112 shows the performance of the method. A third step 113 comprises stopping the method.

The second step 112 may comprise; providing the detonator support; preparing the elongated detonator unit, mounting the first elongated detonator unit in the first detonator support; positioning the cord member at the first or second cord clamping surface; and closing and latching the first detonator support device in said closed state.

Figure 12:
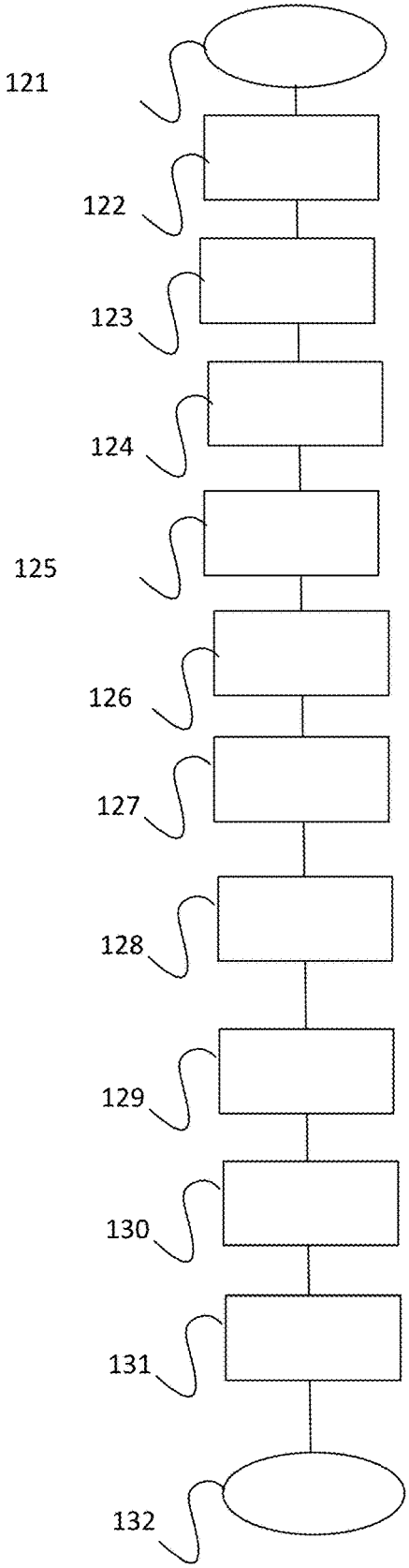
FIG. 12 illustrates a flowchart showing an exemplary method of preparing a first and second detonator support device to be charged in a borehole.

FIG. 12 illustrates a flowchart showing an exemplary method of preparing a first and second detonator support device to be charged in a borehole. A first step 121 starting the method. A second step 122 comprises providing a second detonator support. A third step 123 comprises preparing a second elongated detonator unit. A fourth step 124 comprises mounting the second elongated detonator unit in the second detonator support. A fifth step 125 comprises positioning a cord member at a first or second cord clamping surface of the second detonator support device. A sixth step 126 comprises closing and latching the detonator support in a closed state. A seventh step 127 comprises mounting the prepared first detonator support to the detonator support device receiving portion of a first holding device. An eight step 128 comprises engaging a charging hose nozzle with the intermediate portion of a first holding device. A ninth step 129 comprises propelling the charging hose nozzle into the borehole. A ninth step 130 comprises charging the borehole with an explosive compound. A tenth step 131 comprises returning the charging hose nozzle. An eleventh step 132 comprises stopping the method.

Figure 13:
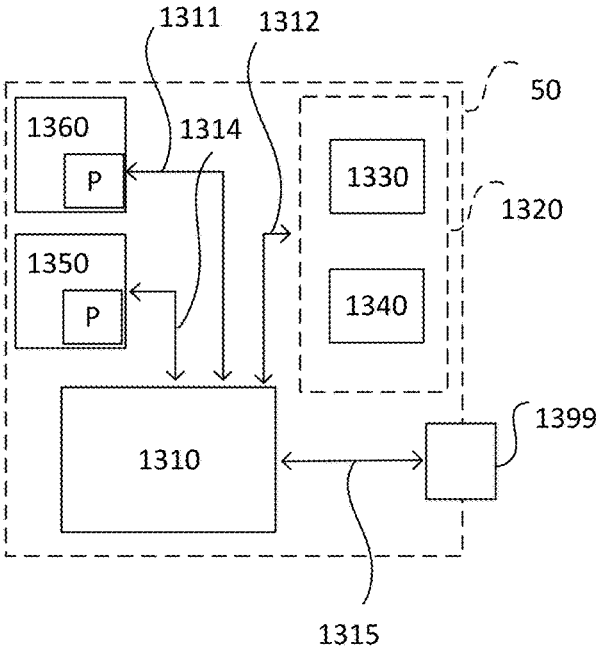
FIG. 13 illustrates a control circuitry adapted to operate an explosive material charging vehicle configured to perform an exemplary method of explosive material charging in a borehole.

FIG. 13 illustrates a control circuitry 50 adapted to operate an explosive material charging vehicle (e.g. shown in FIG. 14) configured to perform an exemplary method of explosive material charging in a borehole. The control circuitry 50 is coupled to an actuator arrangement (not shown) of a robotic arm (not shown) of the explosive material charging vehicle. The control circuitry 50 is configured to perform the method of preparing a detonator support device to be charged in a borehole. The detonator support device is configured for internally supporting an elongated detonator unit, the detonator support device exhibits an upper end and a lower end and comprises a first elongated sidewall hingedly coupled to a second elongated sidewall via a hinge member, a latching member of the detonator support device is configured to secure the first elongated sidewall to the second elongated sidewall in a closed state. A first cord clamping surface of the first elongated sidewall is configured to come in position opposite a second cord clamping surface of the second elongated sidewall in said closed state for engagement with at least one cord member.

The control circuitry 50 may also be configured for manoeuvring the explosive material charging vehicle in the crosscut of the mine (not shown).

The control circuitry 50 may comprise a computer and a non-volatile memory NVM 1320, which is a computer memory that can retain stored information even when the computer is not powered.

The control circuitry 50 further comprises a processing unit 1310 and a read/write memory 1350. The NVM 1320 comprises a first memory unit 1330. A computer program (which can be of any type suitable for any operational data) is stored in the first memory unit 1330 for controlling the functionality of the control circuitry 5. Furthermore, the control circuitry 50 comprises a bus controller (not shown), a serial communication unit (not shown) providing a physical interface, through which information transfers separately in two directions.

The control circuitry 50 may comprise any suitable type of I/O module (not shown) providing input/output signal transfer, an A/D converter (not shown) for converting continuously varying signals from a sensor arrangement (not shown) of the control circuitry 50 configured to determine the actual position of the robotic arm and the charging hose. The control circuitry 50 is configured to, from received control signals, define actual positions of the robotic arm and operation of the explosive material charging vehicle into binary code suitable for the computer, and from other operational data.

The control circuitry 50 also comprises an input/output unit (not shown) for adaptation to time and date. The control circuitry 50 comprises an event counter (not shown) for counting the number of event multiples that occur from independent events in operation of the explosive material charging vehicle.

Furthermore, the control circuitry 50 includes interrupt units (not shown) associated with the computer for providing a multi-tasking performance and real time computing for semi-automatically and/or autonomous maneuvering the explosive material charging vehicle. The NVM 1320 also includes a second memory unit 1340 for external sensor check of the sensor arrangement.

A data medium for storing a program P may comprise program routines for automatically adapting the maneuvering of the explosive material charging vehicle in accordance with operational data of co-operative explosive material charging vehicles (not shown).

The data medium for storing the program P comprises a program code stored on a medium, which is readable on the computer, for causing the control circuitry 50 to perform the method and/or method steps described herein.

The program P further may be stored in a separate memory 1360 and/or in the read/write memory 1350. The program P, in this embodiment, is stored in executable or compressed data format.

It is to be understood that when the processing unit 1310 is described to execute a specific function that involves that the processing unit 1310 may execute a certain part of the program stored in the separate memory 1360 or a certain part of the program stored in the read/write memory 1350.

The processing unit 1310 is associated with a data port 999 for communication via a first data bus 1315 able to be coupled to the robotic arm and the charging hose feeder 79 for performing said method steps.

The non-volatile memory NVM 1320 is adapted for communication with the processing unit 1310 via a second data bus 1312. The separate memory 1360 is adapted for communication with the processing unit 610 via a third data bus 1311. The read/write memory 1350 is adapted to communicate with the processing unit 1310 via a fourth data bus 1314. After that the received data is temporary stored, the processing unit 1310 will be ready to execute the program code, according to the above-mentioned method.

Preferably, the signals (received by the data port 1399) comprise information about operational status of the explosive material charging vehicle. The received signals at the data port 1399 can be used by the control circuitry 50 for controlling and monitoring automatic calibration of the sensor device 1.

Information and data may be manually fed, by an operator, to the control circuitry via a suitable communication device, such as a computer display or a touchscreen.

The method can also partially be executed by the control circuitry 50 by means of the processing unit 1310, which processing unit 1310 runs the program P being stored in the separate memory 1360 or the read/write memory 1350. When the control circuitry 50 runs the program P, the suitable method steps disclosed herein will be executed.

Alternatively, the charging hose in motion is configured to open the openable cover device whilst a stopping arrangement (not shown) of the robotic arm stops the main body.

Figure 14:
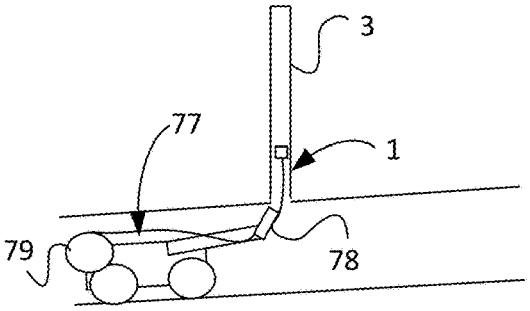
FIG. 14 illustrates an explosive material charging vehicle configured to perform an exemplary method of explosive material charging in a borehole.

FIG. 14 illustrates an explosive material charging vehicle 77 configured to perform an exemplary method of explosive material charging in a borehole 3. The explosive material charging vehicle 77 comprises a robotic arm 78 and a charging hose feeder 79, which are coupled to a control circuitry (not shown, reference 50, see FIG. 13) of the explosive material charging vehicle 77. The control circuitry is configured to control the exemplary method or methods as disclosed herein. The control circuitry comprises a data medium, configured for storing a data program, configured for controlling the blasting system 1 of the explosive material charging vehicle 77. The data medium comprises a program code stored on the data medium, which program code is readable on the control circuitry for performing the method steps.

The present invention is of course not in any way restricted to the preferred embodiments described above, but many possibilities to modifications, or combinations of the described embodiments thereof should be apparent to a person with ordinary skill in the art without departing from the basic idea of the invention as defined in the appended claims.

The invention claimed is:

1. A detonator support device configured for internally supporting an elongated detonator unit, the detonator support device is configured to be used for different blasting charge applications and systems in a borehole, the detonator support device exhibits an upper end and a lower end and comprises: a first elongated sidewall hingedly coupled to a second elongated sidewall via a hinge member, a latching member of the detonator support device is configured to secure the first elongated sidewall to the second elongated sidewall in a closed state, a first cord clamping surface of the first elongated sidewall is configured to come in position opposite a second cord clamping surface of the second elongated sidewall in said closed state for engagement with at least one cord member, an exterior of the first or second elongated sidewall is formed with a concave elongated recess extending along a prolongation of the first or second elongated sidewall, the concave elongated recess is configured to encompass a charging hose used for charging the borehole with the detonator support device.

2. The detonator support device according to claim 1, wherein an interior of the detonator support device is formed with an elongated detonator unit compartment corresponding with exterior dimensions of the elongated detonator unit.

3. The detonator support device according to claim 1, wherein at least the first elongated sidewall comprises at least one opening for providing direct contact between the elongated detonator unit and a blasting charge material to be filled in the borehole.

4. The detonator support device according to claim 3, wherein an interior of the detonator support device exhibits a conical element forming a focal charge, positioned colinear with the elongated detonator unit at one end thereof and being configured to form a plasma jet for impacting the blasting charge material.

5. The detonator support device according to claim 1, wherein the latching member is formed as a snap-fit having at least two snap members, one of which exhibits a different dimension than the other.

6. The detonator support device according to claim 1, wherein the upper end comprises an upper through hole, through which the cord member is configured to pass and/or the lower end comprises a lower through hole, through which the cord member is configured to pass.

7. The detonator support device according to claim 1, wherein an interior of the elongated detonator unit comprises a detonator and an explosive material configured to be coupled to the cord member.

8. The detonator support device according to claim 1, wherein a holding device exhibits a detonator support device receiving portion formed with a cavity configured to releasably encompass the lower end of the detonator support device, an intermediate portion formed with an abutment surface configured to engage a charging hose nozzle of the charging hose, and a radially outward extending borehole plug portion configured to engage the borehole.

9. A holding device exhibiting a detonator support device receiving portion formed with a cavity configured to encompass the lower end of the detonator support device according to claim 1, an intermediate portion formed with an abutment surface configured to engage a charging hose nozzle of the charging hose, and a radially outward extending borehole plug portion configured to engage the borehole.

10. A blasting system configured to be charged in a borehole, the system comprising:

a first detonator support device configured for internally supporting a first elongated detonator unit;

the first detonator support device exhibits an upper end and a lower end and comprises a first elongated sidewall hingedly coupled to a second elongated sidewall via a hinge member, a latching member of the first detonator support device is configured to secure the first elongated sidewall to the second elongated sidewall in a closed state, a first cord clamping surface of the first elongated sidewall is configured to come in position opposite a second cord clamping surface of the second elongated sidewall in said closed state for engagement with a first cord member, an exterior of the first or second elongated sidewall is formed with a concave elongated recess extending along a prolongation of the first or second elongated sidewall, the concave elongated recess is configured to encompass a charging hose used for charging the borehole with the first detonator support device, the system further comprising:

a first holding device configured to engage the borehole and carry the first detonator support device, and a second detonator support device being engaged to the first cord member at a distance from the first detonator support device.

11. The blasting system according to claim 10, wherein the second detonator support device is configured for internally supporting a second elongated detonator unit, the second detonator support device exhibits an upper end and a lower end and comprises a first elongated sidewall hingedly coupled to a second elongated sidewall via a hinge member, a latching member of the second detonator support device is configured to secure the first elongated sidewall to the second elongated sidewall of the second detonator support device in a closed state, and a first cord clamping surface of the first elongated sidewall of the second detonator support device is configured to come in position opposite a second cord clamping surface of the second elongated sidewall of the second detonator support device in said closed state for engagement with the first cord member.

12. The blasting system according to claim 10, wherein the first holding device exhibits an upper portion comprising a detonator support device receiving portion formed with a cavity configured to encompass the lower end of the first detonator support device, an intermediate portion formed with an abutment surface configured to engage a charging hose nozzle of the charging hose, and a lower portion comprising a radially outward extending borehole plug portion configured to engage the borehole.

13. The blasting system according to claim 10, wherein a second holding device exhibits an upper portion comprising a detonator support device receiving portion formed with a cavity configured to encompass a lower end of the second detonator support device, an intermediate portion formed with an abutment surface configured to engage a charging hose nozzle of the charging hose, and a lower portion comprising a radially outward extending borehole plug portion configured to engage the borehole.

14. A method of preparing a first detonator support device to be charged in a borehole, the first detonator support device is configured for internally supporting a first elongated detonator unit, the first detonator support device exhibits an upper end and a lower end and comprises a first elongated sidewall hingedly coupled to a second elongated sidewall via a hinge member, a latching member of the first detonator support device is configured to secure the first elongated sidewall to the second elongated sidewall in a closed state, a first cord clamping surface of the first elongated sidewall is configured to come in position opposite a second cord clamping surface of the second elongated sidewall in said closed state for engagement with at least one cord member, an exterior of the first or second elongated sidewall is formed with a concave elongated recess extending along a prolongation of the first or second elongated sidewall, the concave elongated recess is configured to encompass a charging hose used for charging the borehole with the first detonator support device, the method comprising:

providing the first detonator support device;

preparing the first elongated detonator unit;

mounting the first elongated detonator unit in the first detonator support device;

positioning the cord member at the first or second cord clamping surface; and closing and latching the first detonator support device in said closed state.

15. The method according to claim 14, wherein the method further comprises:

providing a second detonator support device;

preparing a second elongated detonator unit;

wherein the second detonator support device is configured for internally supporting the second elongated detonator unit, the second detonator support device exhibits an upper end and a lower end and comprises a first elongated sidewall hingedly coupled to a second elongated sidewall via a hinge member, a latching member of the second detonator support device is configured to secure the first elongated sidewall to the second elongated sidewall of the second detonator support device in a closed state, a first cord clamping surface of the first elongated sidewall of the second detonator support device is configured to come in position opposite a second cord clamping surface of the second elongated sidewall of the second detonator support device in said closed state for engagement with the first cord member;

mounting the second elongated detonator unit in the second detonator support device;

positioning the cord member at the first or second cord clamping surface of the second detonator support device; and closing and latching the second detonator support device in the closed state.

16. The method according to claim 14, wherein the first detonator support device is configured to be coupled to a first holding device exhibiting an upper portion comprising a detonator support device receiving portion formed with a cavity configured to encompass the lower end of the first detonator support device, an intermediate portion formed with an abutment surface configured to engage a charging hose nozzle of the charging hose, and a lower portion comprising a radially outward extending borehole plug portion configured to engage the borehole, the method further comprising:

mounting the prepared first detonator support device to the detonator support device receiving portion of the first holding device;

engaging the charging hose nozzle with the intermediate portion of the first holding device;

propelling the charging hose nozzle into the borehole;

charging the borehole with an explosive compound; and returning the charging hose nozzle.

17. An autonomous or semi-automatic explosive material charging vehicle, which comprises a robotic arm and a charging hose feeder, which are coupled to a control circuitry, the control circuitry is coupled to an actuator arrangement of the robotic arm, and comprises any I/O module providing input/output signal transfer; an A/D converter for converting continuously varying signals from a sensor arrangement of the control circuitry configured to determine an actual position of the robotic arm and a charging hose;

the control circuitry is configured to define actual positions of the robotic arm from received control signals and operation of the explosive material charging vehicle into binary code for a computer, and from other operational data;

the control circuitry is configured to perform the method of preparing a first detonator support device according to claim 14.

18. A non-transitory computer readable storage medium on which a program is stored for controlling the explosive material charging vehicle according to claim 17 to perform a method of preparing a first detonator support device to be charged in a borehole, the method comprising:

providing the first detonator support device;

preparing a first elongated detonator unit;

mounting a first elongated detonator unit in the first detonator support device;

positioning a cord member at a first or second cord clamping surface of the first detonator support device; and closing and latching the first detonator support device in a closed state.

* * * * *